US006688262B2

(12) United States Patent
Murakami et al.

(10) Patent No.: US 6,688,262 B2
(45) Date of Patent: Feb. 10, 2004

(54) ENGINE COOLING SYSTEM

(75) Inventors: Hiromichi Murakami, Nishikasugai-gun (JP); Daisuke Yamamoto, Komaki (JP); Shigetaka Yoshikawa, Nishikamo-gun (JP); Yoshikazu Shinpo, Nissin (JP); Isao Takagi, Okazaki (JP)

(73) Assignees: Aisan Kogyo Kabushiki Kaisha, Obu (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/164,375

(22) Filed: Jun. 10, 2002

(65) Prior Publication Data

US 2002/0195067 A1 Dec. 26, 2002

(30) Foreign Application Priority Data

Jun. 21, 2001 (JP) ..... 2001-187992

(51) Int. Cl.[7] ..... F07P 7/14
(52) U.S. Cl. ..... 123/41.1
(58) Field of Search ..... 123/41.08, 41.09, 123/41.1

(56) References Cited

U.S. PATENT DOCUMENTS 4,545,333 A * 10/1985 Nagumo et al. ..... 123/41.1
4,616,599 A * 10/1986 Taguchi et al. ..... 123/41.1
4,726,325 A * 2/1988 Itakura ..... 123/41.1

FOREIGN PATENT DOCUMENTS

JP A 10-317965 12/1998

* cited by examiner

*Primary Examiner*—Noah P. Kamen
(74) *Attorney, Agent, or Firm*—Oliff & Berridge, PLC

(57) ABSTRACT

An engine cooling system controls a cooling degree of an engine 1 according to an operating condition thereof by circulating cooling water through the engine. This system is provided with a water temperature sensor 31 for detecting a cooling water temperature THW1, a flow rate regulating valve 8 for regulating a circulation flow rate of the cooling water, and an electronic control unit (ECU) 30 for controlling the valve 8. The ECU 30 sets a non-control region and a first and second control regions, each centering on a target water temperature to be calculated according to operating conditions of the engine 1. The ECU 30 controls the valve 8 to open and close at a high speed when the cooling water temperature THW1 is in the second control region, thereby to allow the cooling water temperature to approach the first control region or at a low speed when the cooling water temperature THW1 is in the first control region, thereby to allow the cooling water temperature to approach the non-control region, or holds the valve 8 at a current opening degree when the cooling water temperature THW1 is in the non-control region.

19 Claims, 8 Drawing Sheets

| | HIGH SPEED | LOW SPEED |
|---|---|---|
| VALVE OPENING DIRECTION | V1a = 0.2 | V2a = 2 |
| VALVE CLOSING DIRECTION | V1b = 0.5 | V2b = 4 |

(UNIT : SEC./STEP)

FIG.9

| NE \ PM | 291Pa | 447Pa | 603Pa |
|---|---|---|---|
| 1200rpm | Vlo=2.0 | Vlo=1.6 | Vlo=1.4 |
| 2400rpm | Vlo=1.8 | Vlo=1.4 | Vlo=1.2 |
| 3600rpm | Vlo=1.6 | Vlo=1.2 | Vlo=1.0 |

(UNIT : SEC./STEP)

FIG.10

| NE \ PM | 291Pa | 447Pa | 603Pa |
|---|---|---|---|
| 1200rpm | Vlc=4.0 | Vlc=3.2 | Vlc=3.4 |
| 2400rpm | Vlc=3.6 | Vlc=2.8 | Vlc=2.4 |
| 3600rpm | Vlc=3.2 | Vlc=2.4 | Vlc=2.0 |

(UNIT : SEC./STEP)

FIG.11

| NE \ PM | 291Pa | 447Pa | 603Pa |
|---|---|---|---|
| 1200rpm | Vho=0.2 | Vho=0.16 | Vho=0.14 |
| 2400rpm | Vho=0.18 | Vho=0.14 | Vho=0.12 |
| 3600rpm | Vho=0.16 | Vho=0.12 | Vho=0.1 |

(UNIT : SEC./STEP)

FIG.12

| NE \ PM | 291Pa | 447Pa | 603Pa |
|---|---|---|---|
| 1200rpm | Vhc=0.5 | Vhc=0.4 | Vhc=0.35 |
| 2400rpm | Vhc=0.45 | Vhc=0.35 | Vhc=0.3 |
| 3600rpm | Vhc=0.4 | Vhc=0.3 | Vhc=0.25 |

(UNIT : SEC./STEP)

ENGINE COOLING SYSTEM

BACKGROUND OF THE INVENTION

1. Field of the Invention

The present invention relates to an engine cooling system of a water-cooling type for cooling an engine by circulation of cooling water through the engine and, more particularly, to an engine cooling system which controls the degree of cooling the engine according to engine operating conditions.

2. Description of Related Art

In conventional mainstream cooling systems of a water-cooling type to be mounted in engines, regardless of operating conditions of the engines, cooling water is generally controlled at a constant temperature of about 80° C. by means of a thermostat. However, changing the cooling degree according to the engine operating conditions (a loaded condition on an engine, engine rotational speed, etc.) has been proved effective in reducing engine friction, increasing fuel efficiency, and improving knocking performance, and so on. Hence there have been proposed some cooling systems of a water-cooling type configured to control the cooling degree according to the engine operating conditions.

This type of the cooling system is basically arranged such that a flow rate regulating valve is controlled to allow the temperature of the cooling water circulating in a cooling water passage in an engine to approach a target water temperature (hereinafter, "target temperature") determined according to the engine operating conditions, thereby changeably controlling the temperature of the cooling water.

However, changes in the cooling water temperature in response to the control of the flow rate regulating valve include a delay in response. Due to this, the actual cooling water temperature would overshoot or undershoot the target temperature and have hunting with respect to the target temperature, causing problems in controllability of the cooling water temperature.

To resolve such the disadvantage, there has been proposed, for example, Japanese Patent Unexamined Publication No. 10-317965 under the title of "Engine cooling water controller". In this controller, a fixed temperature range centrally including a predetermined target temperature is set as a fine-corrected temperature range. While a cooling water temperature detected by a water temperature sensor is within the fine-corrected temperature range, the opening degree of the flow rate regulating valve is increased as the temperature of the cooling water rises or is decreased as the temperature of the cooling water lowers.

The opening degree of the flow rate regulating valve is controlled to become larger when a deviation is large between the cooling water temperature detected at each point in time and the target temperature or to become smaller when the deviation is small.

In the prior art cooling water controller, in the fine-corrected temperature range centrally including the target temperature, if the cooling water temperature is converging at the target temperature, the opening degree of the flow rate regulating valve is only controlled to increase/decrease according to the deviation amount with respect to the target temperature.

As a result, the cooling water temperature could approach the target temperature, but convergence at the target temperature is insufficient and therefore hunting is likely to remain near the target temperature. In this regard, control accuracy of the cooling water temperature with respect to the target temperature has to be further improved.

SUMMARY OF THE INVENTION

The present invention has been made in view of the above circumstances and has an object to overcome the above problems and to provide an engine cooling system with improved accuracy of control for a cooling water temperature with respect to a target water temperature.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an engine cooling system which cools an engine by circulating cooling water in a circulation passage and controls a cooling degree of the engine according to an operating condition of the engine, the system including: a flow rate regulating valve for regulating a circulation flow rate of the cooling water, which is selectively opened and closed at a variable opening and closing speed; water temperature detection means for detecting a temperature of the cooling water circulating in the circulation passage; target water temperature calculation means for calculating a target water temperature according to the operating condition of the engine; control region setting means for setting a first temperature range centering on the calculated target water temperature as a non-control region and a second temperature range centering on the target water temperature and being larger than the first temperature range, excluding the non-control region, as a control region; opening and closing speed control means for controlling the opening and closing speed of the flow rate regulating valve according to a deviation of the cooling water temperature from the target water temperature to allow the cooling water temperature, when the detected cooling water temperature is in the set control region, to approach the non-control region; and opening degree holding means for holding the flow rate regulating valve at a current opening degree when the detected cooling water temperature is in the set non-control region.

According to the above structure, the opening degree of the flow rate regulating valve is controlled to regulate the circulation flow rate of the cooling water, thereby controlling the cooling water temperature, and hence the cooling degree of the engine is controlled. The target temperature calculation means calculates the target water temperature according to the engine operating conditions. The control region setting means sets the first temperature range centrally including the calculated target temperature as the non-control region and the second temperature range centrally including the target temperature, excluding the non-control region, as the control region. While the cooling water temperature is in the control region, the opening and closing control means controls the opening and closing speed of the flow rate regulating valve according to the deviation between the target temperature and the cooling water temperature to bring the cooling water temperature close to the non-control region. Accordingly, in the control region, the opening and closing speed of the valve becomes slow as the cooling water temperature approaches the target temperature. Thus the cooling water temperature, without overshooting or undershooting, can immediately approach the non-control region. Thereafter, when the cooling water falls within the non-control region, the holding means holds the flow rate regulating vale at the current opening degree. The cooling water temperature approaching the target temperature can converge at the target temperature without unnecessary fluctuations.

According to another aspect of the invention, there is provided an engine cooling system which cools an engine by circulating cooling water in a circulation passage and controls a cooling degree of the engine according to an operating condition of the engine, the system including: a flow rate regulating valve for regulating a circulation flow rate of the cooling water, which is selectively opened and closed at a variable opening and closing speed; water temperature detection means for detecting a temperature of the cooling water circulating in the circulation passage; target water temperature calculation means for calculating a target water temperature according to the operating condition of the engine; control region setting means for setting a first temperature range centering on the calculated target water temperature as a non-control region, a second temperature range centering on the target water temperature and being larger than the first temperature range, excluding the non-control region, as a first control region, and a temperature range different from the first and second temperature ranges, centering on the target water temperature and being larger than the second temperature range, excluding the non-control region and the first control region, as a second control region; high speed opening and closing control means for controlling the flow rate regulating valve to selectively open and close at a relatively high speed when the detected cooling water temperature is in the second control region to allow the cooling water temperature to approach the first control region; low speed opening and closing control means for controlling the flow rate regulating valve to selectively open and close at a relatively low speed when the detected cooling water temperature is in the first control region to allow the cooling water temperature to approach the non-control region; and opening degree holding means for holding the flow rate regulating valve at a current opening degree when the detected cooling water temperature is in the set non-control region.

Furthermore, according to another aspect of the invention, there is provided an engine cooling system which cools an engine by circulating cooling water in a circulation passage and controls a cooling degree of the engine according to an operating condition of the engine, the system including: a flow rate regulating valve for regulating a circulation flow rate of the cooling water; water temperature detection means for detecting a temperature of the cooling water circulating in the circulation passage; target water temperature calculation means for calculating a target water temperature according to the operating condition of the engine; opening and closing speed control means for controlling the flow rate regulating valve to selectively open and close according to the calculated target water temperature and the detected cooling water temperature, and controlling an opening and closing speed of the flow rate regulating valve according to the operating condition of the engine.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 9 is a valve opening speed map showing the valve opening speed Vlo of the flow rate regulating valve when a deviation value ΔTHW is smaller than a predetermined reference value th1;

FIG. 10 is a valve closing speed map showing the valve closing speed Vlc of the flow rate regulating valve when the deviation value ΔTHW is smaller than the predetermined reference value th1;

FIG. 11 is a valve opening speed map showing the valve opening speed Vho of the flow rate regulating valve when the deviation value ΔTHW is larger than the predetermined reference value th1; and FIG. 12 is a valve closing speed map showing the valve closing speed Vhi of the flow rate regulating valve when the deviation value ΔTHW is larger than the predetermined reference value th1.

DETAILED DESCRIPTION OF THE PREFERRED EMBODIMENTS

A detailed description of preferred embodiments of an engine cooling system embodying the present invention will now be given referring to the accompanying drawings.

Figure 1:
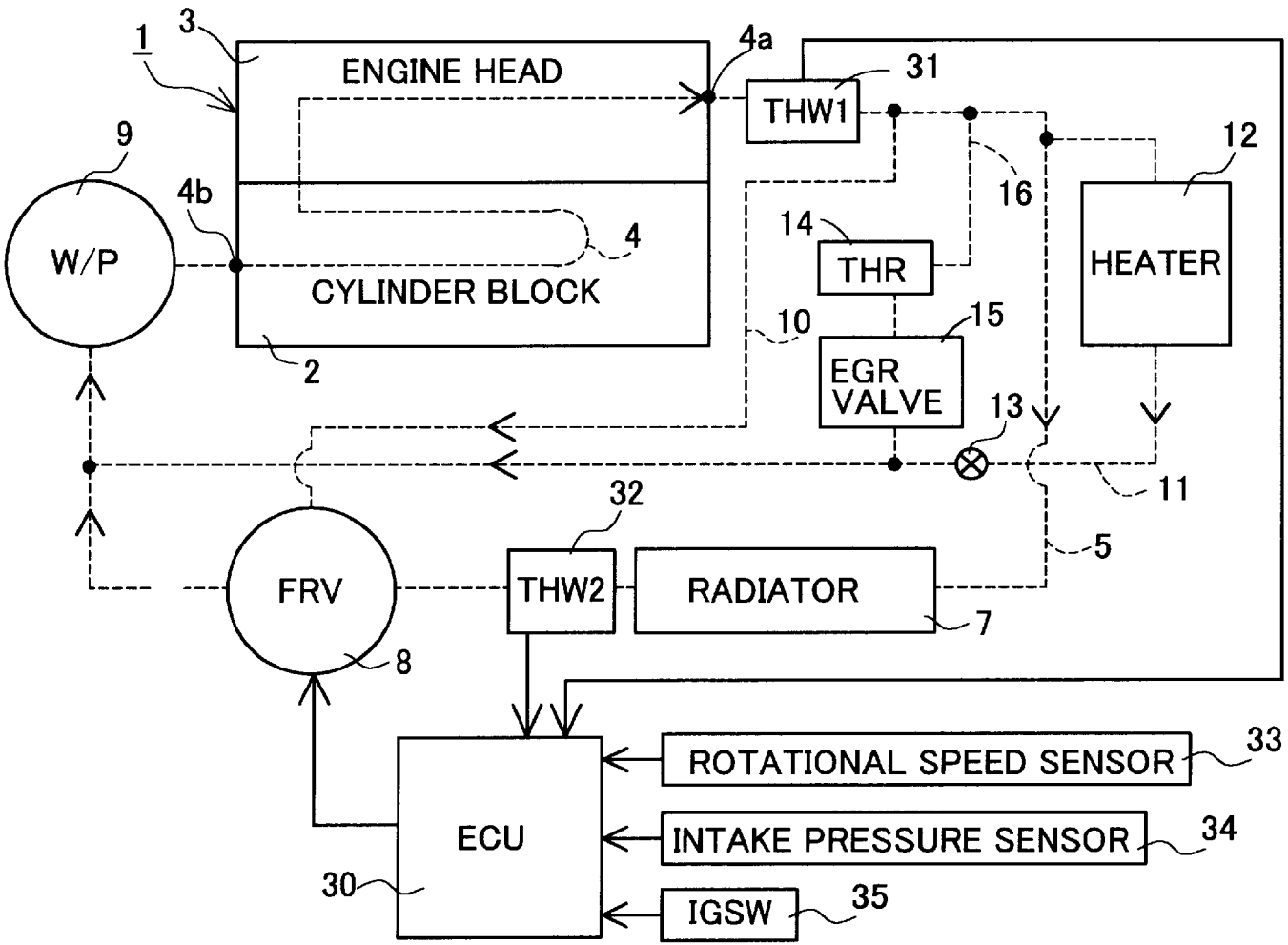
FIG. 1 is a schematic structural view showing an engine cooling system in a first embodiment according to the present invention.

FIG. 1 shows a schematic structural view of the engine cooling system in the present embodiment. An engine 1 mounted on a motor vehicle includes a cylinder block 2 and an engine head 3. This cooling system is to cool the engine 1 by circulating cooling water therein. The cylinder block 2 and the engine head 3 are provided with a cooling-water passage 4 including a water jacket and others.

The passage 4 is connected with a main piping line 5 disposed extending from an outlet 4*a* of the passage 4 to an inlet 4*b* of same to allow fluid communication from the outlet 4*a* to the inlet 4*b*. These passage 4 and the main line 5 and others constitute a circulation passage in which the cooling water is allowed to circulate. In the main line 5, in a direction from the outlet 4*a* side to the inlet 4*b* side, there are disposed a first temperature sensor 31, a radiator 7, a second temperature sensor 32, a flow rate regulating valve (FRV) 8, and a water pump (W/P) 9 in that order.

The first temperature sensor 31 is disposed adjacent to the outlet 4*a* and used to detect a temperature THW1 of the cooling water flowing out of the passage 4 of the engine 1, i.e. an engine outlet side water temperature. The radiator 7 dissipates the heat of the cooling water that absorbed from the engine 1. The second temperature sensor 32 is disposed adjacent to an outlet of the radiator 7 and used to detect a temperature THW2 of the cooling water flowing out of the radiator 7, i.e. a radiator outlet side water temperature. The flow rate regulating valve 8 is electrically controlled to regulate a flow rate of the cooling water circulating in the main line 5 and others. The water pump 9 is actuated by power derived from the engine 1 to produce a flow of the cooling water in the main line 5.

A bypass piping line 10 is arranged between a part of the main line 5 located downstream from the first temperature sensor 31 and the flow rate regulating valve 8. A heater piping line 11 is disposed between another part of the main line 5 located downstream from the first temperature sensor 31 and the water pump 9. In the heater line 11, there is provided a heater 12 for heating the interior of a motor vehicle by dissipating the heat of the cooling water flowing through the heater line 11. A shut-off valve 13 for interrupting the flow of the cooling water through the heater line 11 is also disposed in the line 11.

Between another part of the main line 5 located downstream from the first temperature sensor 31 and the heater line 11, a cooling piping line 16 for cooling a throttle body (THR) 14 and an EGR valve 15 and other attachment devices respectively is arranged.

Figure 2:
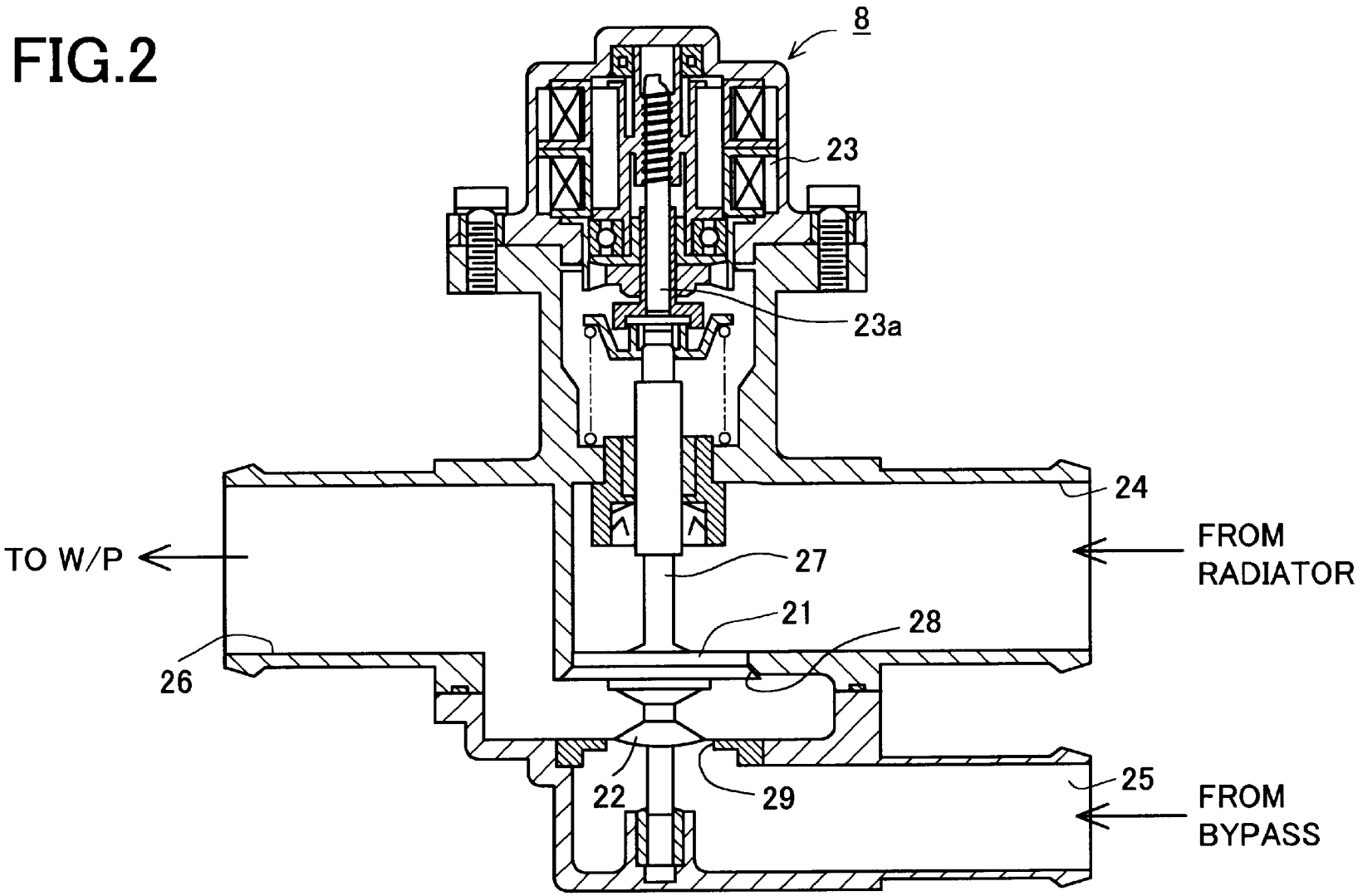
FIG. 2 is a sectional view of a flow rate regulating valve in the system.

FIG. 2 is a sectional view of the flow rate regulating valve 8. This valve 8 includes two valve elements 21 and 22 for regulating a flow rate of the cooling water in the main line 5 and the bypass line 10 respectively. The valve elements 21 and 22 are operated together by a stepper motor 23. The valve 8 is provided with a first inlet port 24, a second inlet port 25, and a single outlet port 26. The first inlet port 24 is connected with the main line 5 to guide the cooling water having flowed out of the radiator 7 into the valve 8. The second inlet port 25 is connected with the bypass line 10. The outlet port 26 is connected with the main line 5. The cooling water having flowed into the valve 8 through the first inlet port 24 and that through the second inlet port 25 are thus discharged together to the main line 5 through the port 26. The two valve elements 21 and 22 are mounted on a valve rod 27 extending from an output shaft 23*a* of the stepper motor 23. In FIG. 2, up-and-down, or axial, motions of the output shaft 23*a* cause simultaneous movement of the valve elements 21 and 22 with respect to a valve seat 28 and a valve port 29 respectively, thereby determining the opening degree of the valve 8.

Figure 3:
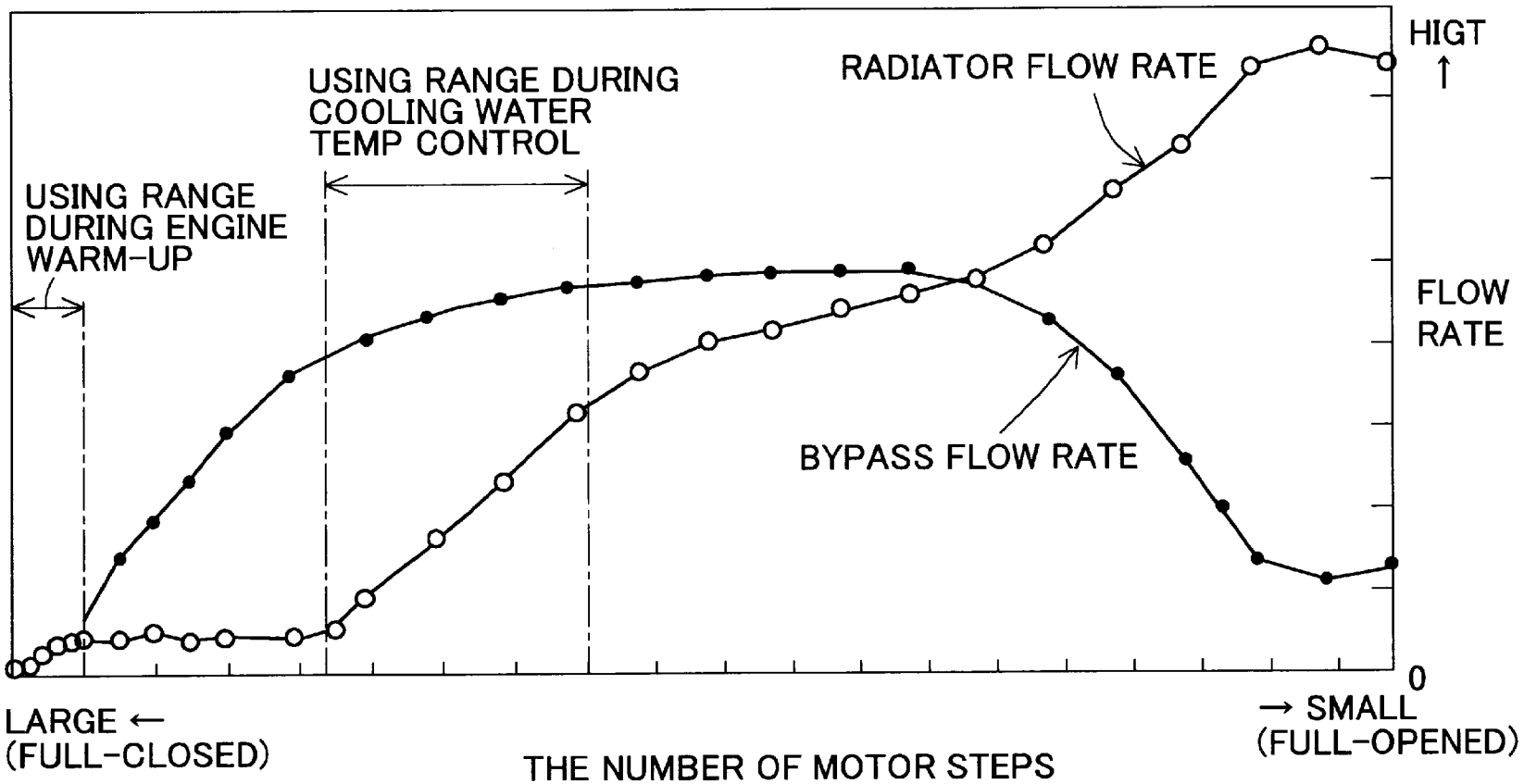
FIG. 3 is a graph showing a flow rate characteristic of the flow rate regulating valve.

FIG. 3 is a graph showing a flow rate characteristic of the flow rate regulating valve 8. In this graph, a lateral axis indicates the number of motor steps of the stepper motor 23 corresponding to a valve opening degree and a vertical axis indicates a flow rate of the cooling water. As clearly seen from this graph, a flow rate of the cooling water flowing through the main line 5 downstream from the radiator 7 (a radiator flow rate) gradually increases as the valve opening degree becomes larger. A flow rate of the cooling water flowing through the bypass line 10 (a bypass flow rate) fluctuates with a peak as the valve opening degree is increased. In this flow rate characteristic, a small opening degree close to a full-closed position is used for warm-up of the engine 1; on the other hand, a middle opening degree is used for control of the temperature of the cooling water.

This cooling system is arranged to control the cooling degree of the engine 1 by controlling the flow rate regulating valve 8 according to the operating conditions of the engine 1 to regulate the flow rate of the cooling water circulating in the engine 1. The system therefore has an electronic control unit (ECU) 30 as shown in FIG. 1. With respect to the ECU 30, the first temperature sensor 31, the second temperature sensor 32, and the flow rate regulating valve 8 are connected respectively. Furthermore, a rotational speed sensor 33, an intake pressure sensor 34, and an ignition switch (IGSW) 35 are connected to the ECU 30 to obtain the operating conditions of the engine 1. The rotational speed sensor 33 detects an engine rotational speed NE and outputs a signal representing a detected value thereof. The intake pressure sensor 34 is disposed in an intake passage (not shown) in the engine 1. This sensor 34 detects an intake pressure PM reflecting the load on the engine 1 and outputs a signal representing a detected value thereof. The ignition switch 35 is operated to start or stop the engine 1.

In the present embodiment, the ECU 30 is to execute the cooling water temperature control, which corresponds to target temperature calculation means, control region setting means, opening and closing speed control means (high speed opening and closing control means, low speed opening and closing control means), and holding means.

As is generally known, the ECU 30 includes a central processing unit (CPU), a read only memory (ROM), a random access memory (RAM), a backup RAM, an external input circuit, an external output circuit, etc. The ECU 30 in which the CPU, ROM, RAM, and backup RAM are connected to the external input circuit and the external output circuit by a bus constitutes a logic operation circuit. In the ROM, a predetermined control program in relation to the cooling water temperature control or the like is stored in advance. The RAM temporarily stores operation results by the CPU. The backup RAM saves previously-stored data. The CPU executes the cooling water temperature control or the like in compliance with the predetermined control program in response to the detection signals input from the sensors 31 through 35 through the input circuit.

Figure 4:
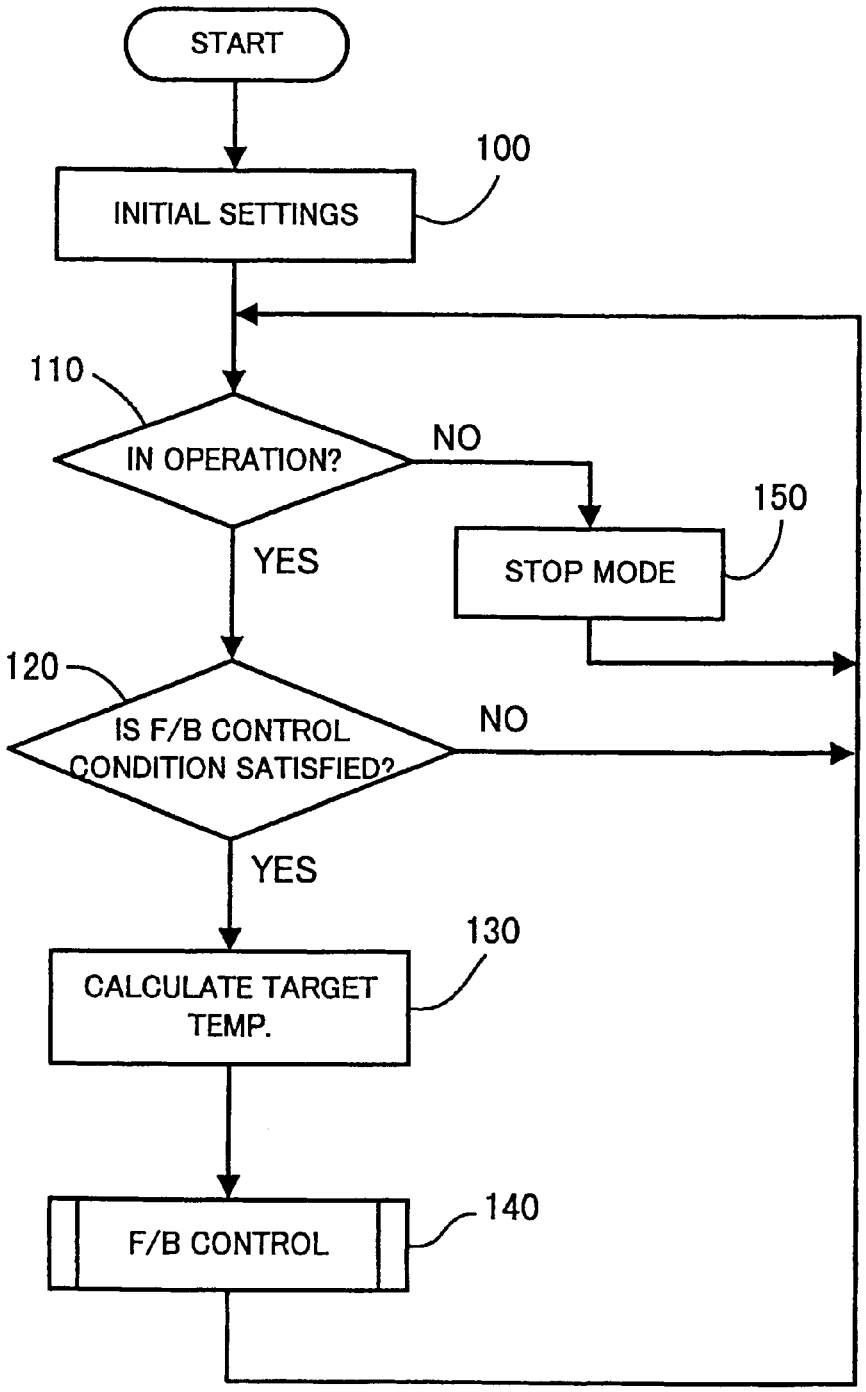
FIG. 4 is a flowchart showing a routine of cooling water control.
Figure 5:
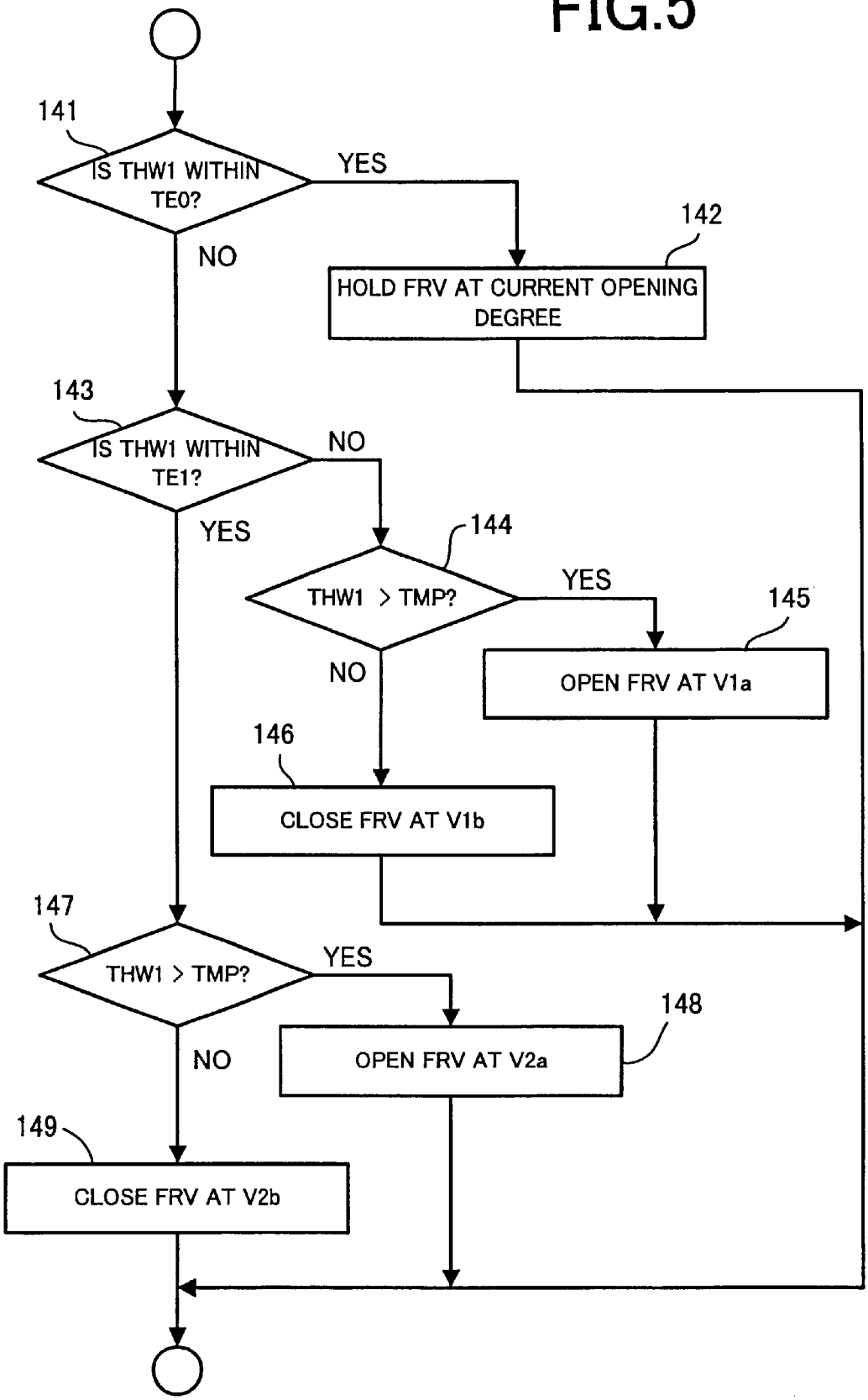
FIG. 5 is a flowchart showing a subroutine of fine control.
Figures 6, 7:
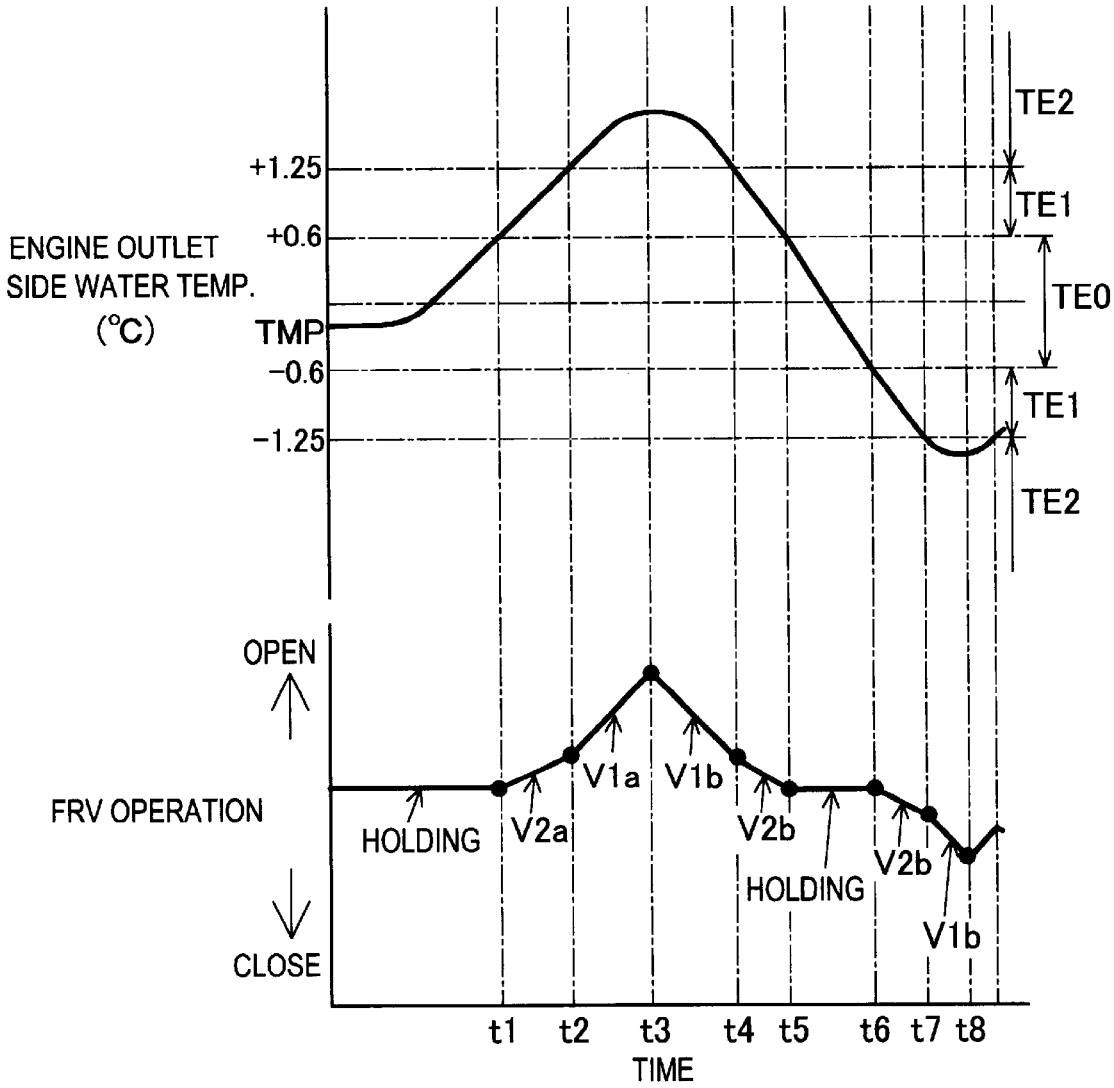
FIG. 6 is a time chart showing a relationship between engine outlet side water temperatures and operations of the flow rate regulating valve.
FIG. 7 is a table showing various operating speeds of the flow rate regulating valve.

The contents of the cooling water temperature control to be executed by the CPU 30 is explained referring to FIGS. 4 to 6. FIGS. 4 and 5 are flowcharts each showing a routine of the control.

Upon turn-on of the ignition switch 35, in step (hereinafter abbreviated as "S") 100, the ECU 30 makes initial settings such as ascertainment of an opening position of the flow rate regulating valve 8 (control to bring the valve element 21 into contact with the valve seat 28, which is referred to as "contact control" in the present embodiment), an A/D processing, and a reset of data in the RAM.

In S110, the ECU 30 determines whether the engine 1 is in operation or not based on detected values of the rotational speed sensor 33 and the intake pressure sensor 34. If it is determined that the engine 1 is not in operation, the ECU 30 enters a predetermined stop mode in S150 and returns the flow of processing to S110. If an affirmative decision is made in S110, the ECU 30 advances the flow to S120.

In S120, the ECU 30 determines whether a predetermined feedback (F/B) control condition is satisfied. More specifically, the ECU 30 determines whether various conditions are satisfied, for instance, whether an engine outlet side water temperature value THW1 detected by the first water temperature sensor 31 becomes coincident with a predetermined control start water temperature. If a negative decision is made in S120, the ECU 30 returns the flow to S110. If an affirmative decision is made in S120, to the contrary, the ECU 30 advances the flow to S130.

In S130, the ECU 30 calculates a target water temperature (hereinafter, target temperature) TMP according to the operating conditions of the engine 1. The ECU 30 performs this calculation based on a separately provided calculation routine (not shown) referring a predetermined map.

In S140, the ECU 30 executes predetermined F/B control. The contents of the F/B control (fine control) in S140 are explained below with reference to a flowchart in FIG. 5.

In S141, at first, as shown in FIG. 6, the ECU 30 defines a first temperature range (±0.6° C. in the present embodiment) centering on the calculated target temperature TMP (for instance, 100° C.) as a non-control region TE0, and determines whether the engine outlet side water temperature THW1 detected by the first water temperature sensor 31 is within the non-control region TE0. If this determination result is affirmative, in S142, the ECU 30 holds the flow rate regulating valve 8 at the current opening degree. If negative, alternatively, the ECU 130 advances the flow to S143.

In S143, as shown in FIG. 6, the ECU 30 defines a second temperature range (±1.25° C. in the present embodiment) having the calculated target temperature TMP (for instance, 100° C.) as the center, excluding the non-control region TE0, as a first control region TE1, and determines whether the engine outlet side water temperature THW1 detected by the first water temperature sensor 31 is within the first control region TE1. If this determination result is negative, the ECU 30 advances the flow to S144.

In S144, the ECU 30 determines whether the engine outlet side water temperature value THW1 is higher than the target temperature value TMP. If an affirmative decision is obtained in S144, the ECU 30 controls the flow rate regulating valve 8 to open at a first high speed V1*a* toward a target opening degree ST. In the present embodiment, the first high speed V1*a* is set to actuate the stepper motor 23 at for example a speed of 1 step per 0.2 sec. If a negative decision is made in S144, alternatively, the ECU 30 controls the flow rate regulating valve 8 to close at a second high speed V1*b* toward the target opening degree ST. In the present embodiment, the second high speed V1*b* is set to actuate the stepper motor 23 at for example a speed of 1 step per 0.5 sec.

If an affirmative decision is obtained in S143, on the other hand, the ECU 30 determines in S147 whether the engine outlet side water temperature value THW1 is higher than the target temperature value TMP. If an affirmative decision is made in S147, the ECU 30 controls the valve 8 to open toward the target opening degree ST at a first low speed V2*a* in S148. In the present embodiment, the first low speed V2*a* is set to operate the stepper motor 23 at for example a speed of 1 step per 2 sec. If a negative decision is made in S147, alternatively, the ECU 30 operates the valve 8 to close toward the target opening degree ST at a second low speed V2*b*. This second low speed V2*b* in the present embodiment is set to operate the stepper motor 23 at for example a speed of 1 step per 4 sec.

In the above way, the ECU 30 executes the fine control related to the flow rate regulating valve 8. FIG. 7 is a table showing differences in the opening and closing speeds of the flow rate regulating valve 8. As seen in FIG. 7, the reason that the opening speed of the valve 8 is set higher than the closing speed is to immediately reduce the temperature of cooling water in order to prevent the cooling water temperature from becoming too high, thereby avoiding occurrence of overheating or other problems.

As explained above, according to the engine cooling system in the present embodiment, the opening degree of the flow rate regulating valve 8 is controlled by the ECU 30 so that the circulation flow rate of the cooling water in the engine 1 and others is regulated and the temperature of the cooling water is controlled. Thus, the cooling degree of the engine 1 is controlled.

As above, the ECU 30 calculates the target temperature value TMP (for instance, 100° C.) according to the operating conditions of the engine 1 at each point in time. In addition, the ECU 30 sets the first temperature range (for instance, ±0.6° C.) centering on the calculated target temperature value TMP as the non-control region TE0; the second temperature range (for instance, ±1.25° C.) excluding the non-control region TE0 centering on the target temperature value TMP as the first control region TE1; and similarly, a third temperature range (for instance, ±2.5° C.) excluding the non-control region TE0 and the first control region TE1 centering on the target temperature value TMP as a second control region TE2.

When the engine outlet side water temperature THW1 is within the second control region TE2, the ECU 30 controls the flow rate regulating valve 8 at a relatively high speed, namely, the first high speed V1*a* or the second high speed V1*b*, so that the engine outlet side water temperature THW1 approaches the first control region TE1. Accordingly, the engine outlet side water temperature THW1 can be changed relatively rapidly from the second control region TE2 toward the first control region TE1. Thereafter, when the temperature THW1 is within the first control region TE1, the ECU 30 controls the flow rate regulating valve 8 at a relatively low speed, namely, the first low speed V2*a* or the second low speed V2*b* so that the temperature THW1 approaches the non-control region TE0. Thus, the temperature THW1 can be changed relatively slowly from the first control region TE1 toward the non-control region TE0. This makes it possible to prevent overshoot and undershoot of the temperature THW1 with respect to the target temperature TMP. When the temperature THW1 falls within the non-control region TE0, the ECU 30 holds the flow rate regulating valve 8 at the current opening degree. This allows the temperature THW1 approaching the target temperature TMP to converge at the target temperature without unnecessary fluctuations. In this way, control accuracy of the engine outlet side water temperature THW1 with respect to the target temperature TMP can be enhanced.

In other words, the prior art system has insufficient convergence of the cooling water temperature at the target temperature, which would still cause hunting in the cooling water temperature. On the other hand, the system in the present embodiment can achieve reduction of hunting in the engine outlet side water temperature THW1. Accordingly, even if the operating condition of the engine mounted in a motor vehicle is suddenly changed, for example, by abruptly shifting to a high speed or from high speed to idle running, and the target temperature TMP is changed correspondingly, the system in the present embodiment can rapidly change the engine outlet side water temperature THW1 to the target temperature TMP. The cooling degree of the engine 1 can also be controlled as desired.

[Second Embodiment]

Next, a second embodiment of the engine cooling system according to the present invention will be explained with reference to attached drawings. In this embodiment, like elements corresponding to those in the first embodiment are indicated by like numerals and their explanations are omitted. Different structures from the first embodiment are mainly described below.

Figure 8:
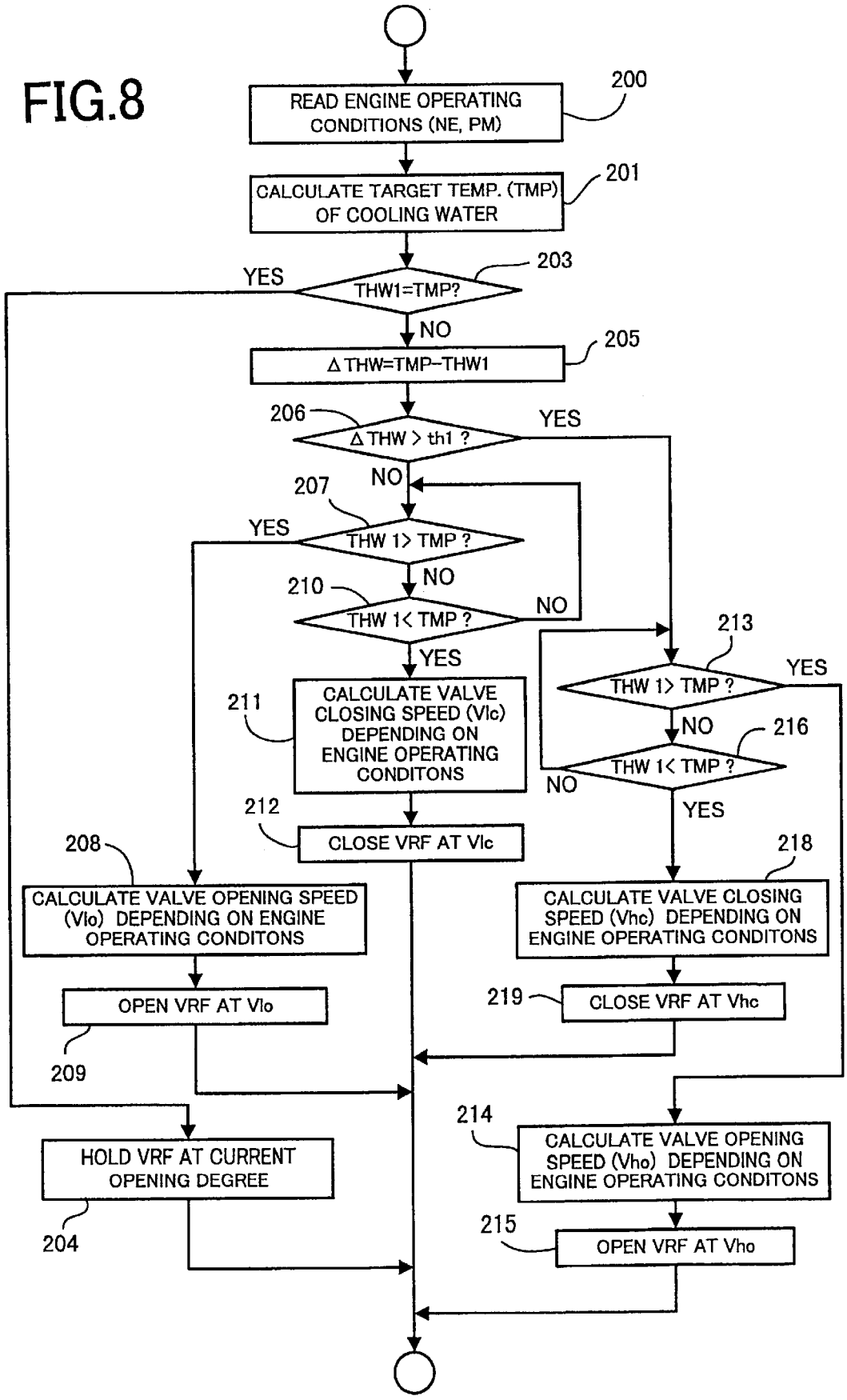
FIG. 8 is a flowchart showing a subroutine of fine control in a second embodiment.

In the second embodiment, the processing contents of the cooling water control to be executed by the ECU 30 differ from those in the first embodiment. More specifically, the second embodiment differs from the first embodiment in the contents of the F/B control (fine control) related to the cooling water temperature in S140 shown in F4. FIG. 8 is a flowchart showing the contents of the F/B control in the second embodiment.

When the flow of processing goes on to S140 in FIG. 4, the ECU 30, at first, in S200 in FIG. 8, reads detection parameters in relation to the operating conditions of the engine 1. In the present embodiment, the ECU 30 reads an engine rotational speed value NE detected by the rotational speed sensor 33 and an intake pressure value PM detected by the intake pressure sensor 34 respectively.

In S201, the ECU 30 calculates a target temperature value TMP according to the engine operating conditions, namely, the read detection parameters NE and PM. The ECU 30, executing the processing in S200 and S201 in the present embodiment, corresponds to target water temperature calculation means of the present invention to calculate a target water temperature TMP according to operating conditions of the engine 1.

In S202, the ECU 30 reads the engine outlet side water temperature value THW1 detected by the first water temperature sensor 31.

In S203, the ECU 30 determines whether the temperature value THW1 is equal to the target temperature value TMP. If an affirmative decision is made, the ECU 30 holds the flow rate regulating valve 8 at the current opening degree in S204. If a negative decision is obtained, to the contrary, the ECU 30 advances the flow to S205.

In S205, the ECU 30 calculates a deviation value ΔTHW of the engine outlet side water temperature value THW1 with respect to the target temperature TMP calculated as above.

In S206, the ECU 30 determines whether this deviation value ΔTHW is larger than a predetermined reference value th1. If this determination result is negative, the ECU 30 determines that the deviation ΔTHW is not relatively large and advances the flow to S207.

In S207, the ECU 30 determines whether the engine outlet side water temperature value THW1 is higher than the target temperature value TMP. If an affirmative decision is obtained, the ECU 30 advances the flow to S208.

In S208, the ECU 30 calculates a valve opening speed Vlo of the flow rate regulating valve 8 for the time when the deviation value ΔTHW is smaller than the predetermined reference value th1, based on the engine operating conditions, to be more specific, in the present embodiment, based on the detection parameters NE and PE, referring to a predetermined valve opening speed map shown in FIG. 9. In this valve opening speed map, the time needed for 1 step of the stepper motor 23 is set such that relatively the higher the engine rotational speed NE, the faster the valve opening speed Vlo, and besides, relatively the higher the intake pressure PM, the faster the valve opening speed Vlo. In S209, the ECU 30 controls the flow rate regulating valve 8 to open at the calculated valve opening speed Vlo.

On the other hand, if a decision in S207 is negative, the ECU 30 determines in S210 whether the engine outlet side water temperature THW1 is lower than the target temperature TMP. If this determination result is negative, the ECU 30 returns the flow to S207. If affirmative, to the contrary, the ECU 30 advances the flow to S211.

In S211, the ECU 30 calculates a valve closing speed Vlc of the flow rate regulating valve 8 for the time when the deviation value ΔTHW is smaller than the predetermined reference value th1, based on the operating conditions of the engine 1, more specifically, based on the detection parameters NE and PM by reference to a predetermined valve closing speed map shown in FIG. 10. In this valve closing speed map, the time needed for 1 step of the stepper motor 23 is set as with the valve opening speed map in FIG. 9, but to be longer than in the valve opening speed Vlo in the map shown in FIG. 9. This setting that the opening speed of the flow rate regulating valve 8 is higher than the closing speed of the valve 8 allows a rapid reduction in the cooling water temperature to prevent the cooling water temperature from becoming too high, thus preventing overheating of the engine 1 or other problems. In S212, the ECU 30 controls the flow rate regulating valve 8 to close at the calculated valve closing speed Vlc.

On the other hand, if an affirmative decision is made in S206, the ECU 30 determines that the deviation ΔTHW is relatively large and advances the flow to S213.

In S213, the ECU 30 determines whether the engine outlet side water temperature value THW1 is higher than the target temperature value TMP. If this determination result is affirmative, the ECU 30 advances the flow to S214.

In S214, the ECU 30 calculates a valve opening speed Vho of the valve 8 for the time when the deviation ΔTHW is larger than the predetermined reference value th1, based on the operating conditions of the engine 1, to be more specific, in the present embodiment, referring to a predetermined valve opening speed map shown in FIG. 11. In this map, the time needed for 1 step of the stepper motor 23 is set as with in the valve opening speed map in FIG. 9, but to be shorter than in the valve opening speed Vlo shown in FIG. 9. This is to bring the cooling water temperature rapidly close to the target temperature when the deviation between the cooling water temperature and the target temperature is large. In S215, the ECU 30 then controls the flow rate regulating valve 8 to open at the calculated valve opening speed Vho.

If the determination result in S213 is negative, the ECU 30 determines in S126 whether the engine outlet side water temperature value THW1 is lower than the target temperature value TMP. The ECU 30 returns the flow to S213 if a negative decision is obtained in S126 or advances the flow to S218 if an affirmative decision is made.

In S218, the ECU 30 calculates a valve closing speed Vhc of the flow rate regulating valve 8 for the time when the deviation ΔTHW is larger than the predetermined reference value th1, based on the engine operating conditions, more specifically, in the present embodiment, based on the detection parameters NE and PM by reference to a predetermined valve closing speed map shown in FIG. 12. In this map, the time needed for 1 step of the stepper motor 23 is set as with the valve opening speed map shown in FIG. 11, but to be longer than in the valve opening speed Vho in the map shown in FIG. 11. This setting that the opening speed of the valve 8 is higher than the closing speed of same allows a rapid reduction in the cooling water temperature to prevent the cooling water temperature from becoming too high, thereby preventing overheating of the engine 1 or other problems. In S219, the ECU 30 controls the valve 8 to close at the calculated valve closing speed Vhc.

In the above manner, the ECU 30 executes the F/B control (fine control) in S140 in the flowchart of FIG. 4. In the present embodiment, the ECU 30 performing the above processing in S203 through S219 corresponds to opening and closing speed control means of the invention to control the opening and closing of the valve 8 according to the calculated target temperature TMP and the detected engine outlet side cooling water temperature THW1 and also control the opening and closing speed of the valve 8 according to the operating conditions of the engine 1.

As explained above, according to the engine cooling system in the present embodiment, the opening degree of the flow rate regulating valve 8 is controlled by the ECU 30, which regulates a circulation flow rate of the cooling water in the engine 1 and others to control the temperature of the cooling water, thereby controlling the cooling degree of the engine 1.

As above, the ECU 30 calculates the target temperature value TMP according to the operating conditions of the engine 1. The first water temperature sensor 31 detects the engine outlet side water temperature value THW1 at each point in time. On a basis of the deviation ΔTHW between the detected temperature THW1 and the target temperature TMP, the opening and closing of the valve 8 is controlled by the ECU 30. This regulates a circulation flow rate of the cooling water to control the cooling water temperature, thus controlling the cooling degree of the engine 1. In addition, according to the operating conditions of the engine 1, the opening and closing of the valve 8 is controlled by the ECU 30 at the valve opening speed Vo and the valve closing speed Vc. This makes it possible to regulate a circulation flow rate of the cooling water in response to differences between abrupt and slow changes in temperature of the cooling water according to the operating conditions of the engine 1 so that the cooling water temperature can be controlled to rapidly approach the target temperature. Accordingly, control accuracy of the engine outlet side water temperature THW1 with respect to the target temperature TMP can be enhanced.

That is to say, the engine cooling system in the present embodiment can also reduce hunting of the engine outlet side water temperature THW1 as compared with the prior art system. Even if the engine operating conditions abruptly change and the target temperature TMP is changed accordingly, the engine outlet side water temperature THW1 can be controlled to rapidly approach the target temperature TMP. Thus, the cooling degree of the engine 1 can be controlled as desired.

For example, the cooling water temperature of the engine 1 may change depending on differences in the amount of heat liberated by the engine 1 in association with changes in the load on the engine 1 or differences in the circulation flow rate of the cooling water in association with changes in the engine rotational speed NE. At this time, a temperature gradient of the cooling water is influenced, which accounts for an abrupt or slow change in the cooling water temperature.

In the present embodiment, on the other hand, the valve opening speed Vo and the valve closing speed Vc are calculated based on the intake pressure PM reflecting changes in the load on the engine 1 and the engine rotational speed NE. Based on these speeds Vo and Vc, furthermore, the flow rate regulating valve 8 is controlled to open and close. This makes it possible to change the circulation flow rate of the cooling water in correspondence with the temperature gradient, so that the engine outlet side water temperature THW1 can rapidly be changed to approach the target temperature TMP. Thus, the cooling degree of the engine 1 can be controlled as desired.

The present invention may be embodied in other specific forms without departing from the spirit or essential characteristics thereof. For instance, the following modifications may be adopted.

(1) In the present embodiment, as shown in FIG. 6, there are provided the first and second control regions TE1 and TE2 as the ranges excluding the non-control region TE0, and the opening/closing speed of the flow rate regulating valve 8 is changed in two steps in correspondence with the ranges TE1 and TE2 individually. Alternatively, the ranges excluding the non-control region may be provided in the order of three to five ranges so that the opening/closing speed of the valve 8 may be changed in three to five steps. In this case, the opening/closing speed of the valve 8 can be controlled step by step in accordance with the deviation between the cooling water temperature and the target temperature to allow the cooling water temperature in the control region approach the non-control region.

(2) FIG. 1 is merely an example of a schematic structural view. The invention may be embodied in an engine cooling system that does not include the cooling passage 16 and others for cooling the throttle body 14 and the EGR valve 15.

(3) In the above embodiments, the first temperature range for the non-control region is set at "±0.6° C.", the second temperature range for the first control region is set at "±1.25° C.", and the third temperature range for the second control region is set at "±2.5° C.". These settings are only examples and may be appropriately changed according to engine displacement and engine type.

(4) In the above embodiments, each calculation of the valve opening speeds Vlo and Vho and the valve closing speeds Vlc and Vhc is performed referring to the maps corresponding to the engine rotational speed NE and the intake pressure PM, furthermore, the deviation ΔTHW between the target temperature TMP and the engine outlet side water temperature THW1. Alternatively, it may be performed by only the engine rotational speed NE and the intake pressure PM.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An engine cooling system which cools an engine by circulating cooling water in a circulation passage and controls a cooling degree of the engine according to an operating condition of the engine, the system including:

a flow rate regulating valve for regulating a circulation flow rate of the cooling water, which is selectively opened and closed at a variable opening and closing speed;

water temperature detection means for detecting a temperature of the cooling water circulating in the circulation passage;

target water temperature calculation means for calculating a target water temperature according to the operating condition of the engine;

control region setting means for setting a first temperature range centering on the calculated target water temperature as a non-control region and a second temperature range centering on the target water temperature and being larger than the first temperature range, excluding the non-control region, as a control region;

opening and closing speed control means for controlling the opening and closing speed of the flow rate regulating valve according to a deviation of the cooling water temperature from the target water temperature to allow the cooling water temperature, when the detected cooling water temperature is in the set control region, to approach the non-control region; and opening degree holding means for holding the flow rate regulating valve at a current opening degree when the detected cooling water temperature is in the set non-control region.

2. The engine cooling system according to claim 1, wherein the engine includes a cylinder block and an engine head both of which include a cooling-water passage including a water jacket, and the cooling-water passage is provided with an outlet and an inlet each of which is connected with a main piping line, the main piping line includes a radiator, the flow rate regulating valve, and a water pump, which are disposed at predetermined positions respectively in the line, the circulation passage includes the cooling-water passage and the main piping line, and the water pump when actuated produces a flow of the cooling water in the main piping line to cause circulation of the cooling water through the cooling-water passage and the main piping line.

3. The engine cooling system according to claim 2, wherein the flow rate regulating valve includes a valve element, a valve seat corresponding to the valve element, an actuator for moving the valve element with respect to the valve seat, the valve element is moved by operation of the actuator between a full-closed position in which the valve element is in full contact with the valve seat and a full-opened position in which the valve element is fully separated from the valve seat, the valve element being moved at a variable moving speed.

4. The engine cooling system according to claim 3, wherein the water temperature detection means is disposed adjacent to the outlet of the cooling water passage to detect the temperature of the cooling water flowing out of the cooling water passage, the engine cooling system further includes operating condition detection means for detecting the operating condition of the engine, the target water temperature calculation means calculates the target water temperature according to the operating condition of the engine based on the detected engine operating condition.

5. The engine cooling system according to claim 4, wherein the target water temperature calculation means, the control region setting means, the opening and closing speed control means, and the opening degree holding means are constituted of an electronic control unit including a central processing unit, a memory, an external input circuit, and an external output circuit.

6. The engine cooling system according to claim 2 further including a bypass piping line disposed providing communication between a part of the main piping line positioned adjacent to the outlet of the cooling-water passage and the flow rate regulating valve, wherein the flow rate regulating valve includes a first valve element for regulating a flow rate of the cooling water flowing through the main piping line, a second valve element for regulating a flow rate of the cooling water flowing through the bypass piping line, a first valve seat corresponding to the first valve element, a second valve seat corresponding to the second valve element, and an actuator for moving the first and second valve elements with respect to the corresponding first and second valve seats respectively, the first and second valve elements are moved by actuation of the actuator with respect to the corresponding first and second valve seats so that the first valve element is moved between a full-closed position in which the first valve element is in full contact with the first valve seat and a full-opened position in which the valve element is fully separated from the first valve seat and the second valve element is moved between two closed positions in which the second valve element is in substantial contact with the second valve seat, the second valve element being fully opened at a predetermined position between the two closed positions; and the first and second valve elements are moved at simultaneously variable moving speeds.

7. An engine cooling system which cools an engine by circulating cooling water in a circulation passage and controls a cooling degree of the engine according to an operating condition of the engine, the system including:

a flow rate regulating valve for regulating a circulation flow rate of the cooling water, which is selectively opened and closed at a variable opening and closing speed;

water temperature detection means for detecting a temperature of the cooling water circulating in the circulation passage;

target water temperature calculation means for calculating a target water temperature according to the operating condition of the engine;

control region setting means for setting a first temperature range centering on the calculated target water temperature as a non-control region, a second temperature range centering on the target water temperature and being larger than the first temperature range, excluding the non-control region, as a first control region, and a temperature range different from the first and second temperature ranges, centering on the target water temperature and being larger than the second temperature range, excluding the non-control region and the first control region, as a second control region;

high speed opening and closing control means for controlling the flow rate regulating valve to selectively open and close at a relatively high speed when the detected cooling water temperature is in the second control region to allow the cooling water temperature to approach the first control region;

low speed opening and closing control means for controlling the flow rate regulating valve to selectively open and close at a relatively low speed when the detected cooling water temperature is in the first control region to allow the cooling water temperature to approach the non-control region; and opening degree holding means for holding the flow rate regulating valve at a current opening degree when the detected cooling water temperature is in the set non-control region.

8. The engine cooling system according to claim 7, wherein the engine includes a cylinder block and an engine head both of which include a cooling-water passage including a water jacket, and the cooling-water passage is provided with an outlet and an inlet each of which is connected with a main piping line, the main piping line includes a radiator, the flow rate regulating valve, and a water pump, which are disposed at predetermined positions respectively in the line, the circulation passage includes the cooling-water passage and the main piping line, and the water pump when actuated produces a flow of the cooling water in the main piping line to cause circulation of the cooling water through the cooling-water passage and the main piping line.

9. The engine cooling system according to claim 8, wherein the flow rate regulating valve includes a valve element, a valve seat corresponding to the valve element, an actuator for moving the valve element with respect to the valve seat, the valve element is moved by operation of the actuator between a full-closed position in which the valve element is in full contact with the valve seat and a full-opened position in which the valve element is fully separated from the valve seat, the valve element being moved at a variable moving speed.

10. The engine cooling system according to claim 9, wherein the water temperature detection means is disposed adjacent to the outlet of the cooling water passage to detect the temperature of the cooling water flowing out of the cooling water passage, the engine cooling system further includes operating condition detection means for detecting the operating condition of the engine, the target water temperature calculation means calculates the target water temperature according to the operating condition of the engine based on the detected engine operating condition.

11. The engine cooling system according to claim 10, wherein the target water temperature calculation means, the control region setting means, the high speed opening and closing control means, the low speed opening and closing control means, and the opening degree holding means are constituted of an electronic control unit including a central processing unit, a memory, an external input circuit, and an external output circuit.

12. The engine cooling system according to claim 8 further including a bypass piping line disposed providing communication between a part of the main piping line positioned adjacent to the outlet of the cooling-water passage and the flow rate regulating valve, wherein the flow rate regulating valve includes a first valve element for regulating a flow rate of the cooling water flowing through the main piping line, a second valve element for regulating a flow rate of the cooling water flowing through the bypass piping line, a first valve seat corresponding to the first valve element, a second valve seat corresponding to the second valve element, and an actuator for moving the first and second valve elements with respect to the corresponding first and second valve seats respectively, the first and second valve elements are moved by actuation of the actuator with respect to the corresponding first and second valve seats so that the first valve element is moved between a full-closed position in which the first valve element is in full contact with the first valve seat and a full-opened position in which the valve element is fully separated from the first valve seat and the second valve element is moved between two closed positions in which the second valve element is in substantial contact with the second valve seat, the second valve element being fully opened at a predetermined position between the two closed positions; and the first and second valve elements are moved at simultaneously variable moving speeds.

13. An engine cooling system which cools an engine by circulating cooling water in a circulation passage and controls a cooling degree of the engine according to an operating condition of the engine, the system including:

a flow rate regulating valve for regulating a circulation flow rate of the cooling water;

water temperature detection means for detecting a temperature of the cooling water circulating in the circulation passage;

target water temperature calculation means for calculating a target water temperature according to the operating condition of the engine;

opening and closing speed control means for controlling the flow rate regulating valve to selectively open and close according to the calculated target water temperature and the detected cooling water temperature, and controlling an opening and closing speed of the flow rate regulating valve according to the operating condition of the engine, wherein the opening and closing control means selects, as the opening and closing speed of the flow rate regulating valve, a relatively high speed value when a deviation of the detected cooling water temperature from the calculated target water temperature is larger than a predetermined reference value and a relatively low speed value when the deviation is smaller than the predetermined reference value, and the engine cooling system further includes opening degree holding means for holding the flow rate regulating valve at a current opening degree when the detected cooling water temperature is equal to the calculated target water temperature.

14. The engine cooling system according to claim 13, wherein the engine includes a cylinder block and an engine head both of which include a cooling-water passage including a water jacket, and the cooling-water passage is provided with an outlet and an inlet each of which is connected with a main piping line, the main piping line includes a radiator, the flow rate regulating valve, and a water pump, which are disposed at predetermined positions respectively in the line, the circulation passage includes the cooling-water passage and the main piping line, and the water pump when actuated produces a flow of the cooling water in the main piping line to cause circulation of the cooling water through the cooling-water passage and the main piping line.

15. The engine cooling system according to claim 14, wherein the flow rate regulating valve includes a valve element, a valve seat corresponding to the valve element, an actuator for moving the valve element with respect to the valve seat, the valve element is moved by operation of the actuator between a full-closed position in which the valve element is in full contact with the valve seat and a full-opened position in which the valve element is fully separated from the valve seat, the valve element being moved at a variable moving speed.

16. The engine cooling system according to claim 15, wherein the water temperature detection means is disposed adjacent to the outlet of the cooling water passage to detect the temperature of the cooling water flowing out of the cooling water passage, the engine cooling system further includes operating condition detection means for detecting the operating condition of the engine, the target water temperature calculation means calculates the target water temperature according to the operating condition of the engine based on the detected engine operating condition.

17. The engine cooling system according to claim 16, wherein the target water temperature calculation means and the opening and closing speed control means are constituted of an electronic control unit including a central processing unit, a memory, an external input circuit, and an external output circuit.

18. The engine cooling system according to claim 14 further including a bypass piping line disposed providing communication between a part of the main piping line positioned adjacent to the outlet of the cooling-water passage and the flow rate regulating valve, wherein the flow rate regulating valve includes a first valve element for regulating a flow rate of the cooling water flowing through the main piping line, a second valve element for regulating a flow rate of the cooling water flowing through the bypass piping line, a first valve seat corresponding to the first valve element, a second valve seat corresponding to the second valve element, and an actuator for moving the first and second valve elements with respect to the corresponding first and second valve seats respectively, the first and second valve elements are moved by actuation of the actuator with respect to the corresponding first and second valve seats so that the first valve element is moved between a full-closed position in which the first valve element is in full contact with the first valve seat and a full-opened position in which the valve element is fully separated from the first valve seat and the second valve element is moved between two closed positions in which the second valve element is in substantial contact with the second valve seat, the second valve element being fully opened at a predetermined position between the two closed positions; and the first and second valve elements are moved at simultaneously variable moving speeds.

19. The engine cooling system according to claim 13 wherein the engine includes a cylinder block and an engine head both of which include a cooling-water passage including a water jacket, and the cooling-water passage is provided with an outlet and an inlet each of which is connected with a main piping line, the main piping line includes a radiator, the flow rate regulating valve, and a water pump, which are disposed at predetermined positions respectively in the line, the circulation passage includes the cooling-water passage and the main piping line, and the water pump when actuated produces a flow of the cooling water in the main piping line to cause circulation of the cooling water through the cooling-water passage and the main piping line.

* * * * *